United States Patent [19]

Smith et al.

[11] 4,444,718

[45] Apr. 24, 1984

[54] METHOD OF MAKING A HIGH CURRENT DENSITY CATHODE

[75] Inventors: Bernard Smith, Wayside; Gerard L. Freeman, Freehold, both of N.J.

[73] Assignee: The United States of America as represented by the Secretary of the Army, Washington, D.C.

[21] Appl. No.: 360,013

[22] Filed: Mar. 19, 1982

[51] Int. Cl.[3] ..... B22F 1/00

[52] U.S. Cl. ..... 419/37; 419/2; 419/36; 445/46; 445/57

[58] Field of Search ..... 419/2, 36, 37; 445/46, 445/57

[56] References Cited

U.S. PATENT DOCUMENTS

| | | | |
|---|---|---|---|
| 4,078,900 | 3/1978 | Smith et al. | 445/51 |
| 4,236,287 | 12/1980 | Smith | 445/51 |
| 4,279,784 | 7/1981 | Misumi et al. | 445/51 |

*Primary Examiner*—Benjamin R. Padgett

*Assistant Examiner*—Anne Brookes

*Attorney, Agent, or Firm*—Robert P. Gibson; Jeremiah G. Murray; Roy E. Gordon

[57] ABSTRACT

A high current density cathode is made by first forming an active porous high purity tungsten pellet by the steps of:

(A) mixing tungsten powder with about 1 to 5 percent by weight of the mixture of an activator powder and compacting the powders at a pressure of about 35 tons per square inch to form a pellet, (B) sintering the pellet in a non-oxidizing atmosphere at about 1800 degrees C. for about $1\frac{1}{2}$ to $3\frac{1}{2}$ hours to the desired porosity, (C) filling the porous pellet with a filler material, (D) machining to the desired size and shape, (E) removing the filler material, and then forming the cathode by impregnating the pellet with $Ba_5Sr(WO_6)_2$ at about 1700 degrees C. in an inert atmosphere and subsequently firing for 2 minutes at 1800 degrees C. in dry hydrogen.

6 Claims, No Drawings

METHOD OF MAKING A HIGH CURRENT DENSITY CATHODE

The invention described herein may be manufactured, used and licensed by or for the Government for governmental purposes without the payment to use of any royalty thereon.

This invention relates to an improved method of making a high current density cathode.

BACKGROUND OF THE INVENTION

In U.S. Pat. No. 4,236,287 issued Dec. 2, 1980 to Bernard Smith for "Method of Making A Ruggedized High Current Density Cathode," there is disclosed and claimed a method of making such a cathode wherein a porous high purity tungsten pellet is impregnated with $Ba_5Sr(WO_6)_2$, and an activator at about 1900 degrees C. in a dry inert gas atmosphere. The difficulty with the method of #4,236,287 is that the impregnation temperature required is too high to meet the emission and sublimation requirements of emitters required for high frequency microwave tubes. That is, during the impregnation step, there is a high loss of barium which limits the life of the cathode. Moreover, due to the high impregnation temperature, there is a loss of barium and activator which translates directly to a loss of beam density with subsequent difficulty in beam control in a linear beam device.

SUMMARY OF THE INVENTION

The general object of this invention is to provide a method of making a high current density cathode which represents an improvement over the method as disclosed and claimed in U.S. Pat. No. 4,236,287. A more specific object of the invention is to provide a method of making a high current density cathode for high power microwave and millimeter tubes for radar systems. A specific object of the invention is to provide a method of making a high current density cathode capable of operating at 1000 degrees C. for thousands of hours at sublimation rates less than $10^{-9}$ gram/cm$^2$/sec.

It has now been found that the foregoing objects can be attained and a high current density cathode obtained by a particular fabrication technique for the porous high purity tungsten pellet followed by impregnation of the pellet with $Ba_5Sr(WO_6)_2$ in an inert atmosphere at a lower temperature than disclosed and claimed in U.S. Pat. No. 4,236,287.

More particularly, according to the method of this invention, an active porous high purity tungsten pellet is first formed by the steps of (A) mixing tungsten powder with about 1 to 5 percent by weight of the total mixture of an activator powder and compacting the powders at a pressure of about 35 tons per square inch to form a pellet, (B) sintering the pellet in a non-oxidizing atmosphere at about 1800 degrees C. for about $1\frac{1}{2}$ to $3\frac{1}{2}$ hours to the desired porosity, (C) filling the porous pellet with a filler material, (D) machining to the desired size and shape, (E) removing the filler material, and then forming the cathode by impregnating the pellet with $Ba_5Sr(WO_6)_2$ at about 1700 degrees C. in an inert atmosphere and subsequently firing for about 2 minutes at 1800 degrees C. in dry hydrogen.

DESCRIPTION OF THE PREFERRED EMBODIMENT

An active porous high purity tungsten pellet is formed by first mixing tungsten powder having a powder size range of about 4 to 15 microns with about 1 to 5 percent by weight of the mixture of zirconium hydride powder and compacting the powders at a pressure of about 35 tons per square inch. The pellet is then placed in a suitable non-oxidizing atmosphere as for example, a vacuum furnace and sintered at about 1800 degrees C. for $1\frac{1}{2}$ to $3\frac{1}{2}$ hours to a porosity of 70 to 80 percent. The porous tungsten pellet is filled with methyl methacrylate plastic and then machined to the desired size and shape without closing or reducing the pores of the tungsten pellet. The filler material is then removed by heating at about 250 to 400 degrees C.

The porous tungsten pellet is then impregnated with $Ba_5Sr(WO_6)_2$ at about 1700 degrees C. in an inert atmosphere and subsequently fired at 1800 degrees C. for 2 minutes in dry hydrogen to form a cathode.

After impregnation, the cathode pellet has a moly sleeve attached to it. The cathode is then ready for assembly into a linear beam device.

In the foregoing description in lieu of or in combination with zirconium hydride as the activator, one may use other compounds such as hafnium hydride, scandium oxide, yttrium oxide or aluminum oxide. In lieu of using an all tungsten pellet, one might use about 5 percent to 25 percent by weight of iridium, rhenium, or osmium along with the high purity tungsten powders and combine this with the desired activator compound. In lieu of sintering in a vacuum in Step (B), one may sinter in a reducing atmosphere as for example, hydrogen.

The $Ba_5Sr(WO_6)_2$ impregnate can be made by mixing stoichiometric amounts of $BaCO_3$,$SrCO_3$ and $WO_3$ necessary to form $Ba_5Sr(WO_6)_2$ according to the equation $5BaCO_3+SrCO_3+2WO_3 \rightarrow Ba_5Sr(WO_6)_2+6CO_2$. The mixture is ball milled overnight and then fired in an air oven at 1475 degrees C. for 2 hours. After firing the powders are removed and ground in a mortar and pestle, sieved, and then refired at 1475 degrees C. for 2 hours.

In the foregoing description, the activator is fabricated in the porous tungsten pellet. Because the activator material (zirconium hydride) is put into the tungsten pellet, standing matrix firing temperatures above 2000 degrees C. cannot be used to obtain the required density. In this invention, the optimum firing times are $1\frac{1}{2}$ to $3\frac{1}{2}$ hours at a temperature of 1800 degrees C. This is necessitated by the fact that the activator is in the porous matrix and higher firing temperatures in a reducing atmosphere would result in the loss of the activator material in the tungsten matrix.

Studies on the impregnated cathodes have shown that the sublimation rate of barium from these cathodes is lower than the sublimation obtained from tungstate cathodes in which the tungsten pellet was made using standard matrix fabrication techniques such as disclosed in U.S. Pat. No. 4,236,287.

It should be pointed out that the method of the invention makes it possible to achieve impregnation at a temperature of about 1700 degrees C. which is well below the melting point of any of the critical compounds in the active mix.

Moreover, a greater control is now obtained over the ratio of the active mix, $Ba_5Sr(WO_6)_2$, to the activator, $ZrH_2$, and a more uniform pore density is obtained. This allows for optimization of the ratio so that one can provide for the minimal amount of sublimation required to keep a monolayer of barium on the cathode surface which is required to achieve a minimum work function.

We wish it to be understood that we do not desire to be limited to the exact details as described for obvious modifications will occur to a person skilled in the art.

What is claimed is:

1. Method of making an active porous high purity tungsten pellet, said method including the steps of:

(A) mixing tungsten powder with about 1 to 5 percent by weight of the mixture of an activator powder selected from the group consisting of zirconium hydride, hafnium hydride, scandium oxide, yttrium oxide and aluminum oxide and compacting the powders at a pressure of about 35 tons per square inch to form a pellet, (B) sintering the pellet in a non-oxidizing atmosphere at about 1800 degrees for about $1\frac{1}{2}$to $3\frac{1}{2}$ hours to the desired porosity, (C) filling the porous pellet with a methyl methacrylate filler material, (D) machining to the desired size and shape, and (E) removing the filler material.

2. Method according to claim 1 wherein the activator powder is zirconium hydride.

3. Method according to claim 1 wherein the tungsten powder has a particle size of about 4 to 15 microns.

4. Method according to claim 1 wherein the non-oxidizing atmosphere in Step (B) is a vacuum.

5. Method according to claim 1 wherein the non-oxidizing atmosphere in Step (B) is hydrogen.

6. Method of making a high current density cathode, said method comprising first forming an active porous high purity tungsten pellet by the steps of (A) mixing tungsten powder with about 1 to 5 percent by weight of the mixture of an activator powder selected from the group consisting of zirconium hydride, hafnium hydride, scandium oxide, yttrium oxide and aluminum oxide and compacting the powders at a pressure of about 35 tons per square inch to form a pellet, (B) sintering the pellet in a vacuum at about 1800 degrees C. for about $1\frac{1}{2}$ to $3\frac{1}{2}$ hours to a porosity of 70 to 80 percent, (C) filling the porous pellet with a methyl methacrylate filler material, (D) machining to the desired size and shape, (E) removing the filler material, and then forming the cathode by impregnating the pellet with $Ba_5Sr(WO_6)_2$ at about 1700 degrees C. in an inert atmosphere and subsequently firing for 2 minutes at 1800 degrees C. in dry hydrogen.

* * * * *